US006367404B1

(12) United States Patent
Callahan

(10) Patent No.: US 6,367,404 B1
(45) Date of Patent: Apr. 9, 2002

(54) FOLDING RIGID-INFLATABLE BOAT

(76) Inventor: Steven Callahan, 130 Seal Point Rd., Lamoine, ME (US) 04605-9625

( * ) Notice: Subject to any disclaimer, the term of this patent is extended or adjusted under 35 U.S.C. 154(b) by 0 days.

(21) Appl. No.: 09/537,337

(22) Filed: Mar. 29, 2000

Related U.S. Application Data

(60) Provisional application No. 60/127,572, filed on Apr. 2, 1999.

(51) Int. Cl.[7] ..... B63B 7/00

(52) U.S. Cl. ..... 114/353; 114/354

(58) Field of Search ..... 114/123, 345, 114/352, 353, 354; 441/40

(56) References Cited

U.S. PATENT DOCUMENTS

| | | | | | |
|---|---|---|---|---|---|
| 1,419,464 | A | * | 6/1922 | Meyer | 114/345 |
| 2,531,549 | A | * | 11/1950 | Boyd | 114/345 |
| 2,794,992 | A | * | 6/1957 | Metzing | 114/352 |
| 2,805,633 | A | * | 9/1957 | Taylor et al. | 441/38 |
| 3,131,406 | A | * | 5/1964 | Cousteau et al. | 441/38 |
| 3,168,751 | A | * | 2/1965 | Cavaignac et al. | 114/345 |
| 3,170,174 | A | * | 2/1965 | Hanel | 114/345 |
| 3,175,234 | A | * | 3/1965 | Kutsi | 114/353 |
| 3,594,834 | A | * | 7/1971 | Steensen | 114/353 |
| 3,659,298 | A | * | 5/1972 | Edwards | 114/345 |
| 3,694,836 | A | * | 10/1972 | Serra | 114/345 |
| 3,834,410 | A | * | 9/1974 | Leibel | 135/123 |
| 3,932,906 | A | | 1/1976 | Johnson | |
| 4,031,580 | A | | 6/1977 | Neumann et al. | |
| 4,057,865 | A | * | 11/1977 | Trautwein | 114/345 |
| 4,231,131 | A | * | 11/1980 | Young | 114/345 |
| 4,597,355 | A | | 7/1986 | Kirby | |
| 4,671,202 | A | | 6/1987 | Johnson | |
| 4,730,573 | A | | 3/1988 | Koon | |
| 4,766,918 | A | * | 8/1988 | Odekirk | 52/2.23 |
| 4,807,555 | A | * | 2/1989 | Hart | 114/345 |
| 4,807,556 | A | * | 2/1989 | Hillier | 114/345 |
| 4,942,839 | A | | 7/1990 | Chuan | |
| 5,070,807 | A | * | 12/1991 | Lewis | 114/361 |
| 5,088,434 | A | * | 2/1992 | Harding | 114/85 |
| 5,183,002 | A | | 2/1993 | Parker | |
| 5,342,230 | A | * | 8/1994 | Louis | 441/42 |
| 5,353,733 | A | * | 10/1994 | Evans | 114/353 |
| 5,800,225 | A | * | 9/1998 | Shoaff, III | 441/38 |
| 5,823,283 | A | * | 10/1998 | Mamonov | 180/116 |
| 5,868,097 | A | * | 2/1999 | Spickelmire | 114/353 |

OTHER PUBLICATIONS

Cruising World; "The Proactive Emergency Craft"; by Steven Callahan; Published Dec., 1995; entire article.

Tinker—The Versatile Inflatables; "Tinker Fold Away RIB—The Rigid Inflatable Boat that Folds Away"; Published prior to Apr. 2, 1999; entire article.

Switlik; Coastal Life Raft; Published prior to Apr. 2, 1999; entire brochure.

* cited by examiner

*Primary Examiner*—S. Joseph Morano
*Assistant Examiner*—Ajay Vasudeva
(74) *Attorney, Agent, or Firm*—Adams, Schwartz & Evans, P.A.

(57) ABSTRACT

A folding rigid-inflatable boat for routine and emergency use by occupants as an auxiliary watercraft. The floating rigid-inflatable boat includes a hull having complementary rigid bow and rigid stern sections joined together along common, centrally disposed joint edges, a hinge element extending laterally from port to starboard along the centrally disposed joint edges and pivotally connecting the bow and stern sections together for permitting the bow and stern sections to be folded onto themselves into a storage configuration and into an unfolded use configuration; and inflatable topsides secured to the hull and extending around the periphery of the hull for providing an upwardly extending freeboard and for further providing rigidity to the hull when the boat is in the unfolded use configuration.

17 Claims, 7 Drawing Sheets

FOLDING RIGID-INFLATABLE BOAT

This non-provisional application is a continuation of prior provisional application Ser. No. 60/127,572, filed Apr. 2, 1999.

TECHNICAL FIELD AND BACKGROUND OF THE INVENTION

This invention relates to a boat particularly intended for routine and emergency use by its occupants as an auxiliary watercraft. The invention is the result of the inventor's thirty years of sailing experience combined with his survival experience in a conventional life raft.

Most mariners need launches or dinghies for routine commuting between ship and shore, and should carry conventional life rafts or boats for emergencies at sea. In many instances, however, mariners have limited space or a limited budget, and thus cannot own both a dinghy and an emergency auxiliary watercraft. Although some mariners have retrofit inflatable or rigid dinghies to serve as emergency craft, such craft are rarely optimally designed for use in emergencies. Rigid dinghies tend to be small and ship water easily. They provide little stability or shelter in a seaway. Inflatable dinghies likewise tend to provide little shelter, and unless engine power is applied, their maneuverability and speed is extremely limited in all but very light conditions. Inflatable dinghies are also vulnerable to total failure from even a single puncture.

Although mariners should carry certified lifesaving devices such as SOLAS-approved life rafts, survivors of boating accidents have relied upon a wide variety of other watercraft, even though many of those watercraft were ill-suited for emergencies. Analysis of numerous survival drifts reveals that many ocean survivors could not only dramatically reduce their time adrift, but also ease conditions while adrift, if they could pilot watercraft having even modicum amounts of mobility and maneuverability. More maneuverable and speedier watercraft would allow mariners to reach shores than those resting directly downwind, which is the only direction conventional life rafts typically travel. Use of such watercraft would also increase the likelihood of intercepting shipping or search and rescue crews, and would allow mariners to navigate towards rainfall or other desirable environmental conditions.

Mariners are best served by multiple emergency auxiliary watercraft when abandoning slip; therefore, volume and weight allowances for auxiliary watercraft are of prime importance. Unfortunately, smaller pleasure craft often simply do not have room to accommodate multiple emergency auxiliary watercraft. Given that the performance, comfort and safety of an emergency auxiliary watercraft increases tremendously as its size increases, resorting to a smaller auxiliary watercraft necessarily creates higher risks for a mariner in an emergency situation.

Attempts to solve these problems have resulted in a number of auxiliary watercraft having varying shapes, sizes and functions—and a number of disadvantages. Rigid dinghies, for example, have a rigid bottom and provide superior performance, yet require maximum space for storage. Folding rigid dinghies do not reduce the cubic footage of the stored watercraft. Take-apart, nesting dinghies or collapsible dinghies relying upon multiple rigid plates, fabric hinges, or complex internal frameworks usually require assembly before launching, and often compromise stability and safety.

Attempts have been made in the past to solve the problems mentioned above. The English-built Tinker folding rigid-inflatable boat is the only dinghy now in production of which the inventor is aware that allows mariners to fold a folding rigid-inflatable boat into a smaller package for storage. U.S. Pat. No. 4,597,355 likewise discloses a folding rigid-inflatable boat. However, neither Tinker's folding rigid-inflatable boat or the folding rigid-inflatable boat of the '355 Patent have been designed to be deployed during emergencies at sea. The invention disclosed in the '355 Patent is limited to a single embodiment of a V-bottomed, engine-oriented vessel. In addition, both the Tinker invention and the folding rigid-inflatableboat disclosed in the '355 Patent rely upon hinge mechanisms composed of flexible fabrics, which are more vulnerable to wear and deterioration as well as distortion during use than hinges created with rigid materials. The hinge mechanisms used by Tinker and disclosed in the '355 Patent both require the hinge fulcrum to rest flush with the top of the bulkhead, interior platform, or sole, and the bottom of the inflatable topside elements. This limits the range of watercraft designs to which the hinge mechanisms can be applied because the topsides must not extend upwards of the hinge fulcrum.

The '355 Patent discloses partial bulkheads, which theoretically allow the folding rigid-inflatable boat to fold into a package consuming significantly less cubic footage. It should be noted, however, that the fulcrum of the hinge joint disclosed in the '355 Patent is precisely at the juncture between the inflated topsides and the rigid bottom element. As the boat folds, no space is provided for the topsides, even if deflated, not to mention the space required to fold the portion of the hull used for connecting the inflated topsides. In the highly unlikely event that this design were to work, it would require the hinge fulcrum to rest flush with the bottom of the inflatable topsides, resulting in restricting the topside height of the rigid hull.

U.S. Pat. No. 4,671,202 also discloses a folding rigid-inflatable boat having fabric hinges and bulkheads for waterproofing the joint between the bow and stern hull elements. The bulkheads of the '202 Patent are high enough at the hinge to prevent water from entering the craft, which is usually at or above gunwale height. Such bulkheads place significant obstacles within the craft and when the hull is folded, create a height equal to twice that of the unfolded hull. Furthermore, the stored hull consumes no less cubic footage. The purpose of a folding boat is to allow it, when not in use, to be stored in a space that is smaller in one or more dimensions. The '202 Patent discloses full-height bulkheads with gaskets; however, such gaskets can still leak, especially as the craft bounces around and twists over a seaway.

U.S. Pat. No. 4,942,839 discloses a folding rigid-inflatable boat having a stability device attached directly to the hull or contained within hull chambers. Unlike the present invention, which includes a stability device attached asymmetrically to the hull to concentrate forces to avoid capsizing or rolling, the stability device of the '839 Patent is distributed symmetrically around the perimeter of the craft, which may compromise stability by placing the weight and drag on the leeward side.

The invention of the present application offers an innovative and safer alternative to traditional auxiliary watercraft. The invention is a boat that includes a tough, rigid hinge element that is independent of any bulkheads. The hinge element is preferably a scissors hinge; however, a butterfly hinge, piano hinge or other suitable hinge may be used to suit the boat type and specific application. The boat is adaptable to any shaped hull, be it a v-bottomed hull designed to be primarily engine-driven or a round-bottom hull designed to be driven primarily by oars or sail. The preferred embodiment of the invention includes a round-bottom hull featuring higher rigid topsides than a typical folding rigid-inflatable boat. The invention includes inflatable topsides that are folded inside the boat for storage after the inflatable topsides are deflated. The invention may also include an automatic inflation device as is used in conventional life rafts for unfolding and inflating the inflatable topsides with the pull of a cord. The hinge element includes a fulcrum that can be placed at any height in the hull, thereby providing enough room when the boat is folded to make room between the folded hull for folded inflatable topsides material and any other folded elements. The boat preferably includes a hinge, a screw pin or similar latching mechanism to secure the bow and stem sections of the hull together. This structure enhances the rigidity of the hull when the boat is in an unfolded use configuration. The inflatable topsides provide the boat with enough rigidity to allow boarding before the latching mechanism is secured.

The invention disclosed in the present application also includes gaskets to cushion rigid bow and stern elements, thus slowing the inward seepage of water. Unlike prior art folding rigid-inflatableboats, however, the present invention does not rely upon gaskets for preventing outside water from entering the interior of the boat. Rather, the hinge element of the boat is made watertight with a membrane, or a loose, fabric waterdam, that attaches to not only the bow and stern rigid-bottom elements, but also to the inflatable or pop-up topsides. The waterdam thus encloses the hinge element between the bow and stern sections, and isolates the interior of the boat from the outside. Should water make its way between the bow and stern sections, the water will be retained by the waterdam and will not flow freely to the inside of the boat. To prevent the volume and weight of water trapped and collected by the waterdam from becoming excessive, the waterdam can be rolled and secured or pressed flat with weights from stores or seated passengers. The waterdam allows the hinge element to be placed at any convenient height in the boat.

Although bulkheads may be used in the present invention, these are not essential. Unlike the '355 Patent, which discloses a folding rigid-inflatable boat having bulkheads whose tops are at the same height as the bottom of the inflatable topsides, the bulkheads of the present invention may be placed at any height. Placing the bulkheads in this manner reduces obstacles along the bottom of the boat, allowing mariners to stretch out and distribute their body weight along the hull to enhance boat stability. Placing the bulkheads in this manner also allows the design of a boat having rigid topsides along the entire length of the hull and below the inflatable topsides, which lifts the inflatable topsides above the waterline, thereby reducing drag and promoting efficiency and speed.

The invention of the present application includes several other elements designed to enhance safety and increase maneuverability. For example, the invention as disclosed includes a canopy, a stability device, at least one sole compartment, and storage lockers. The canopy and drogue can be removed in whole or part while the boat is being used in port under normal conditions. The stability device is preferably an attached fabric drogue for providing added stability in heavy seas. While prior art boats and other watercraft employ drogues or sea anchors that are trailed on a line, the drogue of the present invention is attached asymmetrically and directly to the hull of the boat to concentrate the forces that resist a capsize or roll on one region of the craft. The stability device of the present invention combines elements of both drogues and water ballast. The drogue provides dynamic resistance as the boat moves through the water, much like a parachute does as it slows an object's descent through the air. The stability device also contains a significant quantity of water to provide added resistance for avoiding lifting. The drogue also provides resistance to give the boat directional stability, and to resist capsizing or pitch poling. In poor conditions, the drogue is preferably carried aft, allowing the boat to drift with the bow of the boat pointed downwind, but may also be carried forward to point the bow into the wind and waves. When drifting downwind, the raised bow of the invention has significant buoyancy, which helps the boat negotiate seas, particularly when the stem is lifted by large breakers. The stability device of the present invention is also the only hull-attached stability device that is fully retrievable from the water, thereby reducing drag when not in use. The boat may further include conventional sea anchors to enhance stability.

The invention of the present application also includes a canopy supported by at least one hinged hoop support. The canopy is unique to auxiliary craft which are specifically designed for use in emergency situations. The canopy is attached to the bow and stern sections of the hull and along the periphery of the inflatable topsides. The canopy enhances the crew's protection from the elements. The hinged hoop supports promote canopy flexibility. The canopy includes canopy bow and stern sections, and is unique to all types of craft in that the canopy can be partially or completely erected, folded or removed to allow mariners to adjust and orient portions of the canopy to enhance balance protection from the elements with maximizing access to the outside. To protect passengers or cargo, the bow portion of the canopy may be used and the stern section of the canopy removed to avoid wear. The canopy can be attached to the rigid hull by fitting into tracks stretching fore and aft along the rigid hull elements, or it can simply wrap around the tubes while being secured to mechanical attachment points on the rigid hull. As the boat is folded, the attached canopy collapses and can be stored within the folded boat where the canopy can remain ready for use.

The canopy also includes a ridge tether, which allows the canopy to automatically erect as the boat opens into the unfolded use configuration. Alternatively, the canopy can be deployed simply by pulling the bow and stem hinged hoop supports and then securing them together.

The invention also includes at least one sealed sole compartment with storage lockers in which to secure emergency equipment.

The invention of the present application provides an auxiliary watercraft having approximately twice the length and six to eight times the volume of a normal rigid launch or dinghy, and offers enhanced stability and superior sea-going capabilities. The invention includes a rigid-inflatable boat configuration, which features inflatable topsides matched to a rigid hull. Unlike the prior art, however, the inflatable topsides may either be composed of the typical folding rigid-inflatable boat inflatable tubes, or they may be composed of "pop-up" fabric topsides supported by a collapsible, rigid gunwale element and supporting struts. When the inflatable topsides are deflated or collapsed, the volume of the boat is significantly reduced.

The invention of the present application is designed for maximizing maneuverability, safety and comfort, while minimizing storage space and inconvenience. Although the invention is not intended to be relied upon as a lifesaving device nor intended to be certifiable as a life raft or life boat by any national or international agency under current laws and regulations, it is designed with seagoing capability and usefulness in emergencies foremost in mind, and is also very utilitarian as a launch under non-emergency circumstances.

SUMMARY OF THE INVENTION

Therefore, it is an object of the invention to provide a boat that is flexible and can be adapted to a number of different boat configurations in order to suit the diverse needs of various mariners.

It is another object of the invention to provide a boat that can be stored in a compact space.

It is another object of the invention to provide a boat capable of being deployed quickly and without complicated assembly.

It is another object of the invention to provide a boat constructed to provide maximum strength and reliability over a prolonged period of use and during periods of heavy weather.

It is another object of the invention to provide a boat that offers crew and essential gear reasonable shelter from the elements.

It is another object of the invention to provide a boat capable of making reasonable speed under power by oar, sail, kite, or engine, and capable of holding a course at significant angles to dead downwind.

It is another object of the invention to provide a boat having components which are removable and replaceable, thereby enhancing routine performance, protecting emergency components from wear during use, and allowing the crew to easily repair the boat while it is in remote locations, or replace components of the boat if they wear out or are improved over time.

These and other objects of the present invention are achieved in the preferred embodiments disclosed below by providing a folding rigid-inflatable boat for routine and emergency use by occupants, the watercraft including a hull having complementary rigid bow and rigid stern sections joined together along common, centrally disposed joint edges, and a hinge element extending laterally from port to starboard along the centrally disposed joint edges and pivotally connecting the bow and stern sections together for permitting the bow and stern sections to be folded onto themselves into a storage configuration and into an unfolded use configuration. The boat also includes inflatable topsides secured to the hull and extending around the periphery of the hull for providing an upwardly extending freeboard and for further providing rigidity to the hull when the boat is in the unfolded use configuration and for emergency reserve buoyancy.

Preferably, the hinge element comprises at least two scissor hinges or one piano hinge.

According to another preferred embodiment of the invention, supplemental securing means are included for securing the bow section and stern section together in the unfolded use configuration to define a rigid hull.

According to yet another preferred embodiment of the invention, the bow section and stern section of the boat have respective mating bulkheads for being joined together when the boat is in the unfolded use configuration, and includes supplemental securing means comprising at least one securing screw pin for locking the bulkheads in a mating position.

Preferably, the bulkheads include gasket means for cushioning, and sealing the bow and stern sections and creating an enhanced barrier against water intrusion.

According to yet another preferred embodiment of the invention, the boat includes a membrane enclosing the hinge element and affixed to the bow section, stern section and inflatable topsides, for isolating the interior of the boat from water intrusion through the hinge element.

Preferably, the membrane comprises a fabric waterdam extending laterally from port to starboard and enclosing the hinge element and the jointed edge between the bow and stern rigid hull elements, thereby preventing water leakage into the boat through the centrally disposed joint edges and the hinge element.

According to yet another preferred embodiment of the invention, the boat includes a retrievable drogue connected to the hull and deployable into the water for providing drag to the boat and thus resistance against capsizing or excessive hull rolling.

Preferably, the drogue is asymmetrically connected to the hull.

According to yet another preferred embodiment of the invention, the boat may include rigid topsides positioned intermediate with the hull and the inflatable topsides. The rigid topsides have a lower edge extending around the periphery of and connected to the hull, thereby extending the freeboard of the boat and positioning the inflatable topsides above the waterline reducing drag on the hull.

According to yet another preferred embodiment of the invention, the boat includes an automatic inflation device for inflating the inflatable topsides.

According to yet another preferred embodiment of the invention, the boat includes at least one sealed sole compartment defined by the hull for promoting buoyancy of the boat.

Preferably, the sealed sole compartment includes at least one storage locker positioned within the sole compartment for storing emergency equipment within the storage locker.

According to yet another preferred embodiment of the invention, the boat includes a canopy for being positioned and retained over the hull for protecting the occupants of the boat.

According to yet another preferred embodiment of the invention, the canopy comprises removable canopy bow and canopy stern sections for being connected to the inflatable topsides, and at least one hinged hoop support connected to and for supporting the canopy.

According to yet another preferred embodiment of the invention, the canopy includes a plurality of watertight windows and a doorway.

According to yet another preferred embodiment of the invention, the boat includes a ridge tether attached to the canopy for allowing the canopy to automatically deploy as the bow and stern sections are unfolded into the unfolded use configuration and the inflatable topsides are inflated.

According to yet another preferred embodiment of the invention, the canopy is wrapped around the inflatable topsides and attached to the hull by a plurality of mechanical attachment devices.

According to yet another preferred embodiment of the invention, the canopy includes at least one tie-line extending from the hinged hoop support for being tied to at least one attachment point on the hull for promoting flexibility of the canopy during use.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND THE BEST MODE

Figure 1:
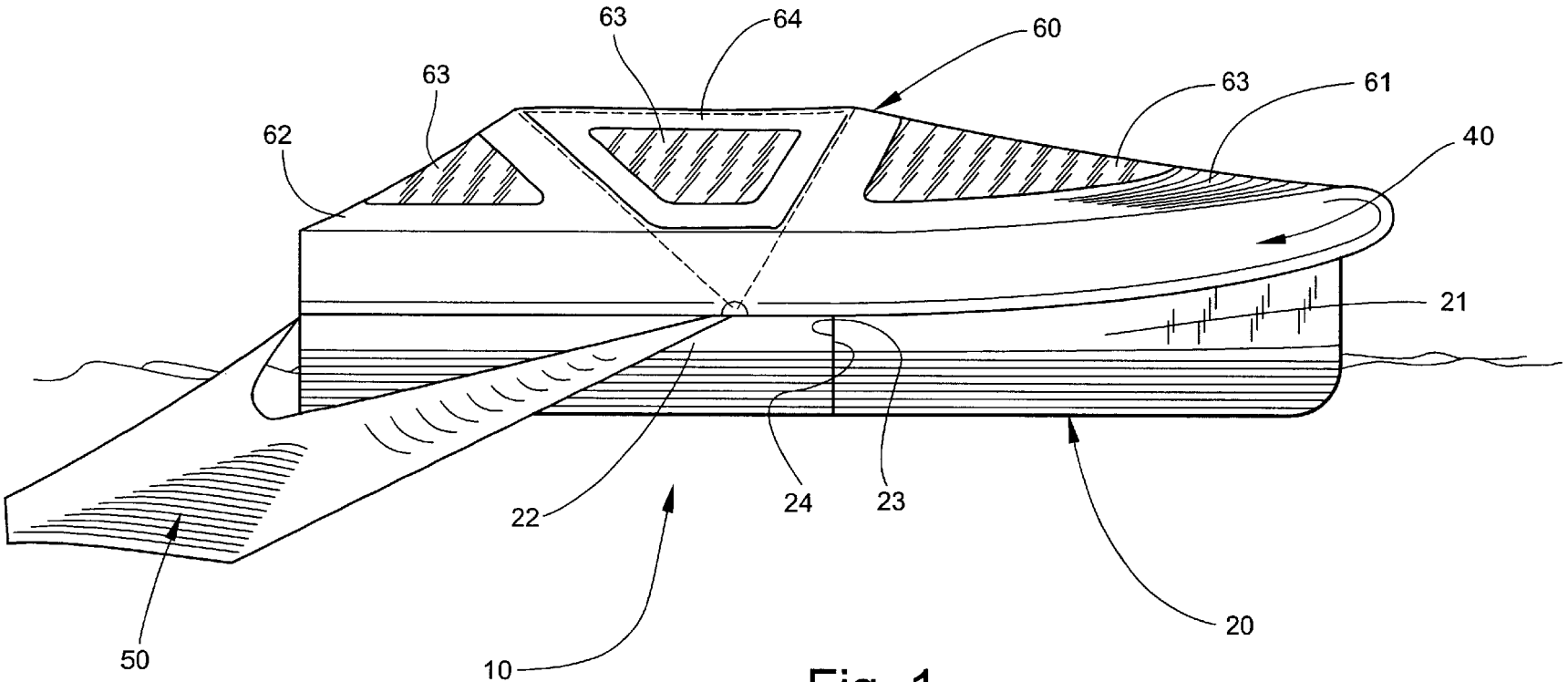
FIG. 1 is a side elevation of a folding rigid-inflatable boat according to an embodiment of the invention.

Referring now specifically to the drawings, a boat according to the present invention is illustrated in FIG. 1 and shown generally at reference numeral 10. The boat 10 is formed using commonly available materials and components which may be easily and inexpensively manufactured and supplied, and broadly includes a hull 20, a hinge element 30 (see FIG. 2), inflatable topsides 40, a drogue 50, and a canopy 60. As shown in FIG. 1, the hull 20 is preferably round-bottomed and designed to be driven primarily by oar or sail. However, the hull may also be V-bottomed and designed to be primarily engine driven. The hull 20 is preferably formed from a composite material such as one including fiberglass, KEVLAR, composite carbon fibers, wood, formed plastic such as PVC, metal and the like. The hull 20 includes a bow section 21 and stern section 22 joined together along centrally disposed joint edges 23 and 24, respectively. The bow section 21 is highly swept in order to enhance how the boat 10 negotiates open-water waves.

The inflatable topsides 40 are secured to, and extend around the periphery of, the hull 20. The inflatable topsides 40 are preferably formed of a composite, woven fabric such as HYPALON or of PVC film. The drogue 50 is preferably formed of DACRON or nylon fabric, and is shown in FIG. 1 preferably asymmetrically attached by attachment devices 51(see FIGS. 2 and 3) aft of, and to, the stern section 22.

Figure 3:
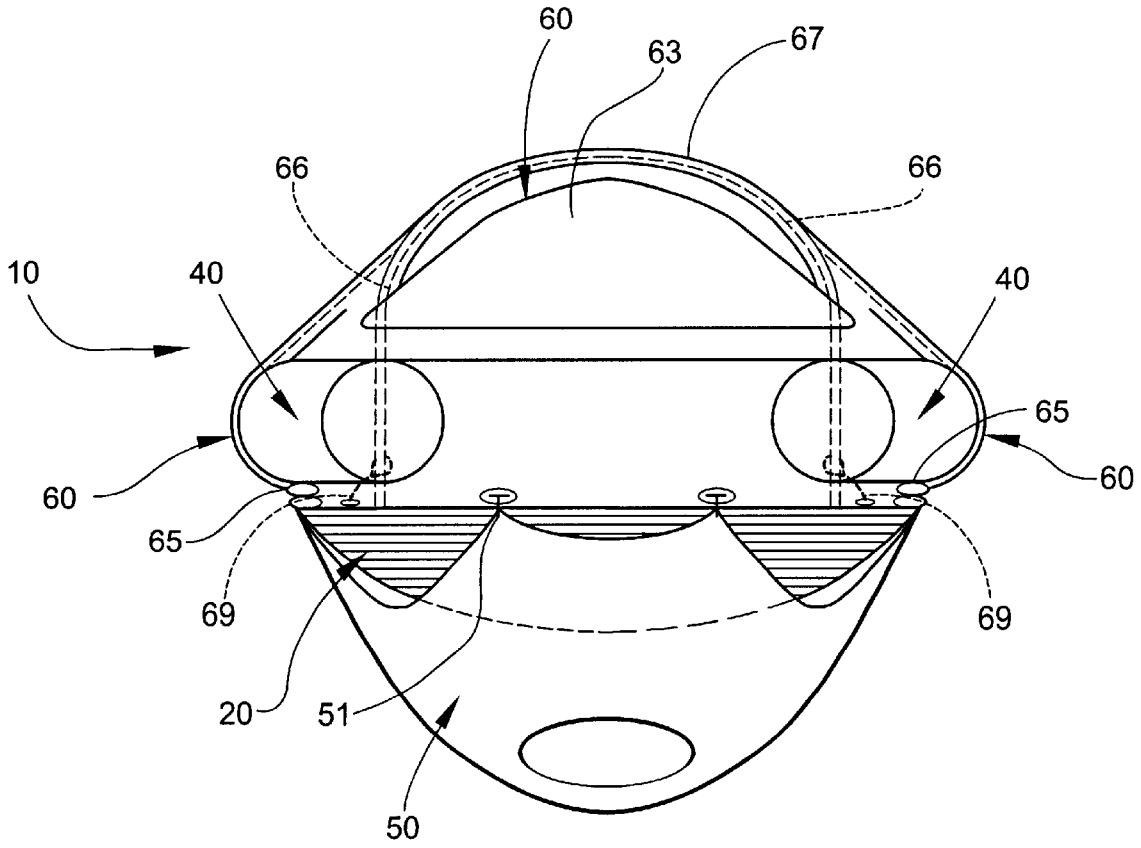
FIG. 3 is a rear elevation of the stern of the boat.

As is shown in FIG. 1, the boat 10 also includes a canopy 60. The canopy 60 is preferably formed of a waterproof fabric, and includes a canopy bow section 61 and canopy stem section 62. The canopy 60 includes a plurality of watertight windows 63, and a doorway 64 which connects the canopy bow section 61 and canopy stern section 62. As is shown in FIG. 3, the canopy 60 wraps around the inflatable topsides 40 and is secured to the hull 20 by a plurality of mechanical attachment points 65, such as pad eyes. A hinged hoop support 66 is connected to and supports the canopy 60 by a connecting sleeve 67. The connecting sleeve 67 is preferably a tubular sleeve formed in the canopy 60 into which the hinged hoop support 66, which is shown drawn in phantom, is inserted and pulled through the canopy 60 in much the same manner as standard tent poles are installed through a standard camping tent. When erected and scaled, the canopy 60 forms an unstable shape, which promotes rerighting when the boat 10 is overturned.

The canopy 60 contains watertight windows 63 through which the outside of the boat 10 can be viewed, even with the canopy 60 completely closed. This helps mariners resist seasickness and maintain a watch for rescue craft while remaining protected. As is shown in FIG. 1, the canopy also includes a central doorway 64 that connects the bow and stern sections 61 and 62, respectively, of the canopy 60 and keeps tile canopy 60 erected. The doorway 64 can be rolled up and secured when the canopy 60 is stored, thereby allowing immediate boarding in an emergency. Alternative tie-lines 69 from the support hoops to attachment points on the rigid-hull elements may also be used to keep sections of the canopy bow and stern erected separately.

Figure 2:
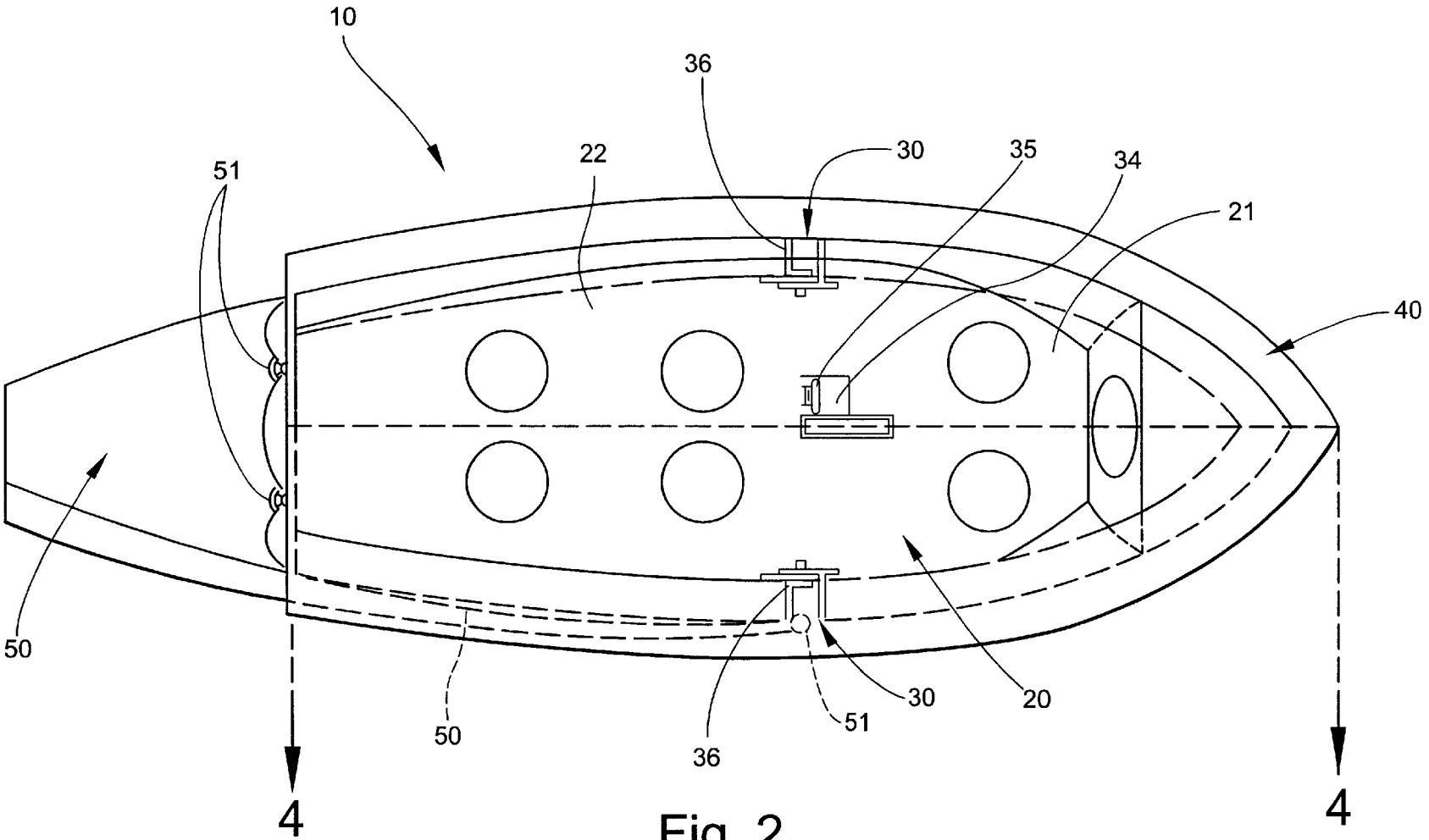
FIG. 2 is a top plan view of the boat shown without a canopy.

As is shown in FIG. 2, the hinge element 30 connects the bow and stern sections 21 and 22, respectively, along the centrally disposed joint edges 23 and 24. The hinge element 30 is preferably formed from at least two scissor hinges 36 that, as are shown in FIG. 2, attach the bow and stern sections 21 and 22, respectively, together.

Figure 4:
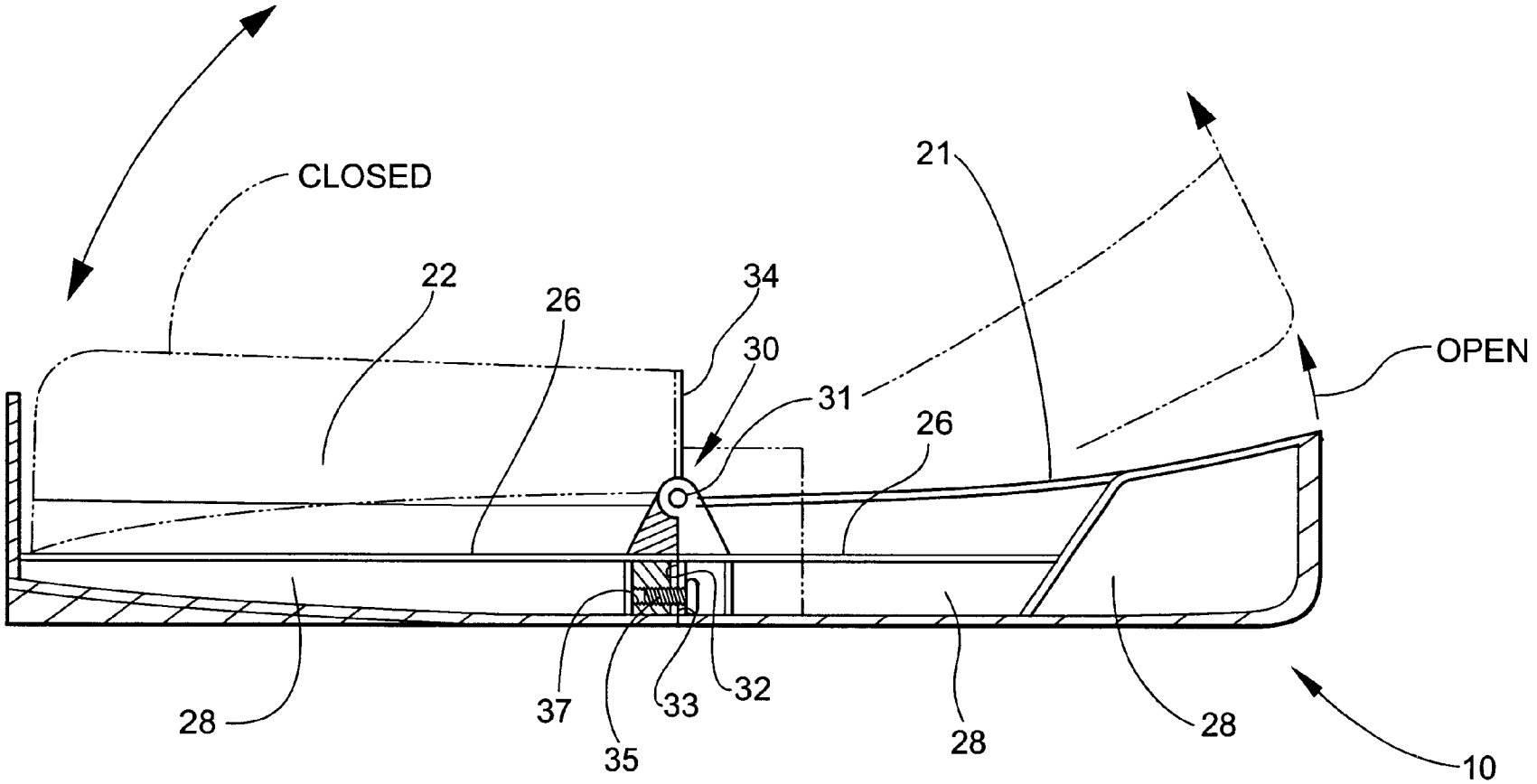
FIG. 4 is a cross-sectional side elevation of the boat shown in FIG. 1.

As is shown in FIG. 4, the unfolded use configuration of the boat 10 is referenced by a solid line as "OPEN." The closed use configuration is drawn in phantom and referenced by a phantom line as "CLOSED." FIG. 4 shows the bow and stern sections 21 and 22 including sealed sole compartments 26, which contain a plurality of storage lockers 28 in which emergency and other equipment may be stored. The sealed sole compartments 26 help to make the boat 10 unsinkable even without the use of the inflatable topsides 40. The sealed sole compartment 26 within the bow 21 helps to retain buoyancy high in the boat 10 and promotes rerighting, should the boat 10 be overturned.

FIG. 4 also shows a supplemental securing device, which preferably comprises at least one securing screw pin 35. The securing screw pin 35 is attached to the bow bulkhead 32, and is threaded into a mating receptacle 37 in the stern bulkhead 33 for locking tile bow and stern bulkheads 32 and 33, respectively, together.

Figure 5:
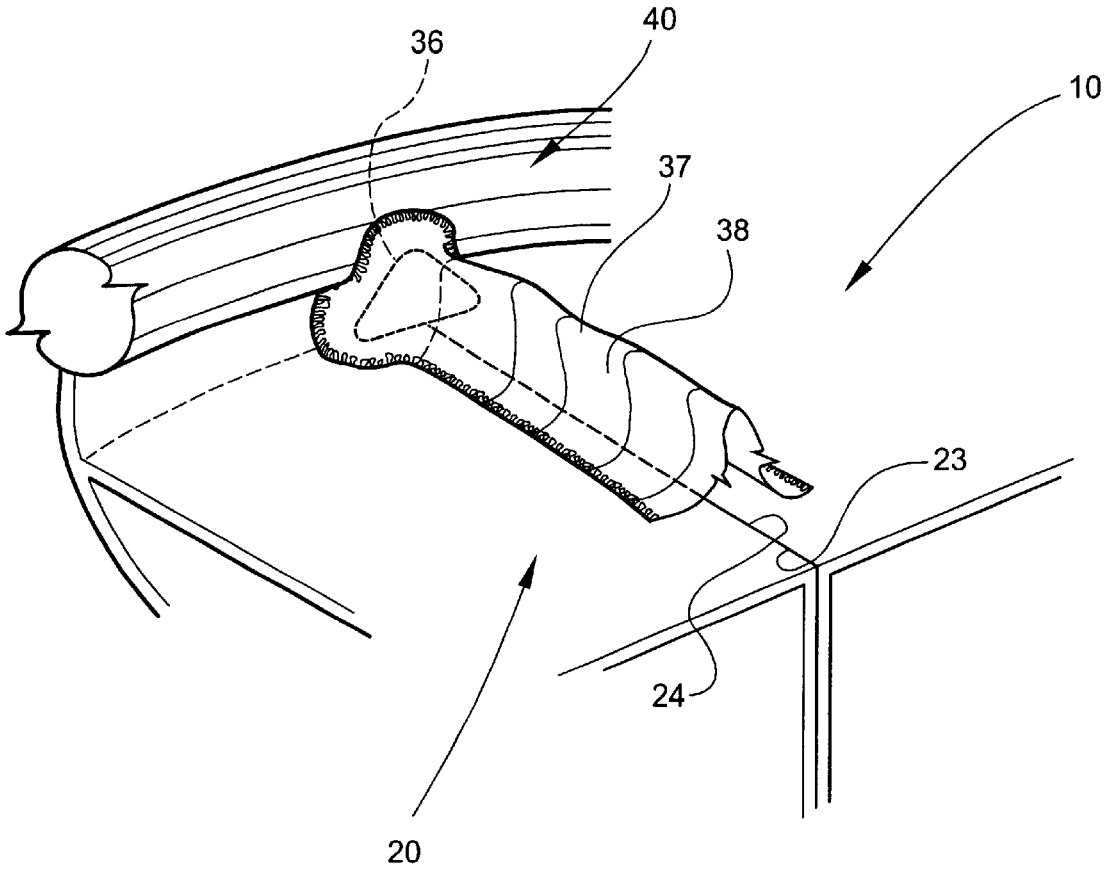
FIG. 5 is a cut-away view of a fabric waterdam encompassing one scissor hinge, and folding rigid-inflatable boat according to another embodiment of the invention.

FIG. 5 shows a scissor hinge 36 and the joint edges 23 and 24 enclosed by a membrane 37 and affixed to the bow section 21, stern section 22 and inflatable topsides 40. Tile membrane 37 is preferably a waterproof fabric waterdam 38 that extends laterally from port to starboard and encloses the joint edges 23 and 24, thereby preventing water leakage into the boat 10 through the joint edges 23 and 24, and the hinge element 30.

Figure 6:
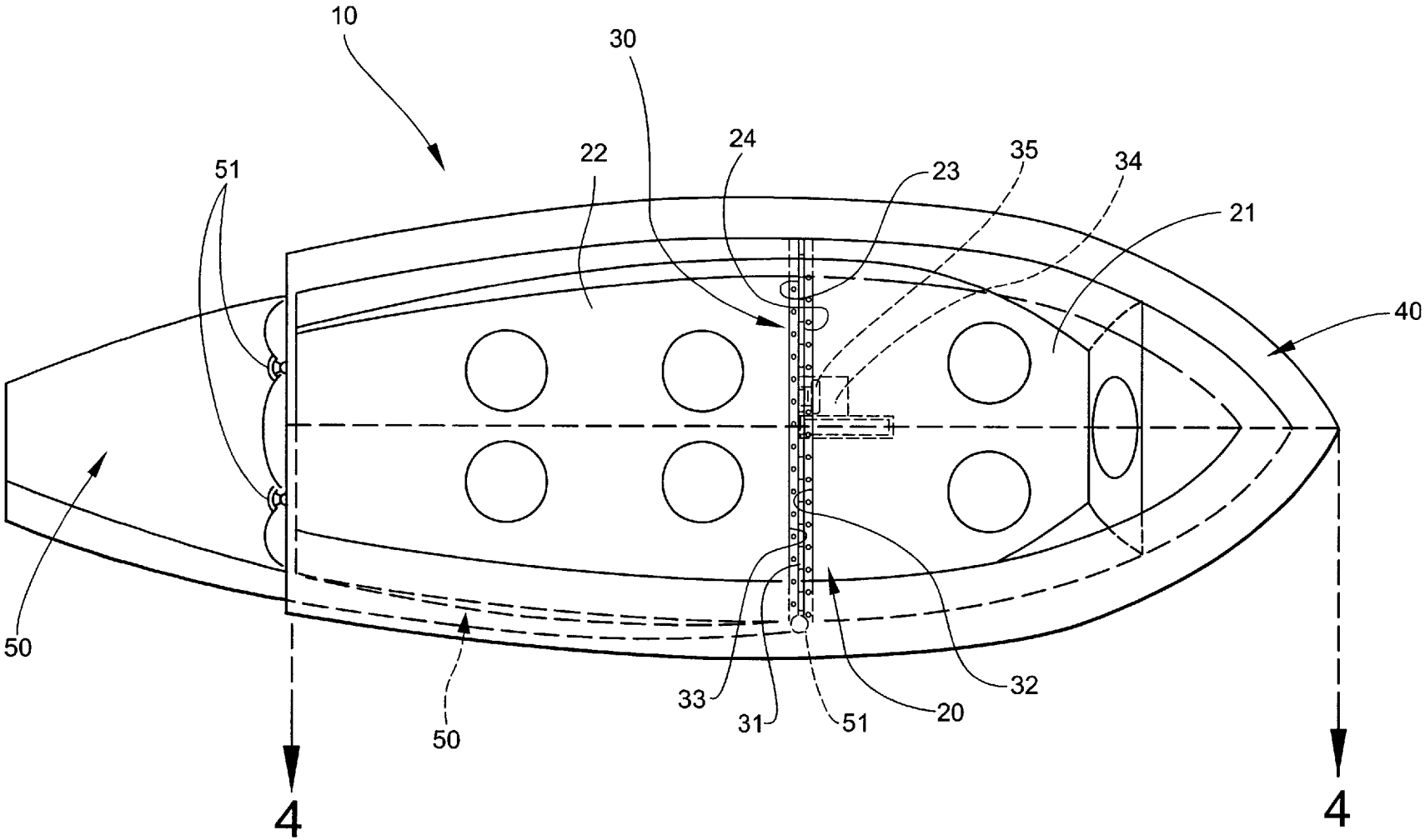
FIG. 6 is a top plan view of an alternate embodiment of the folding rigid-inflatable boat.
Figure 7:
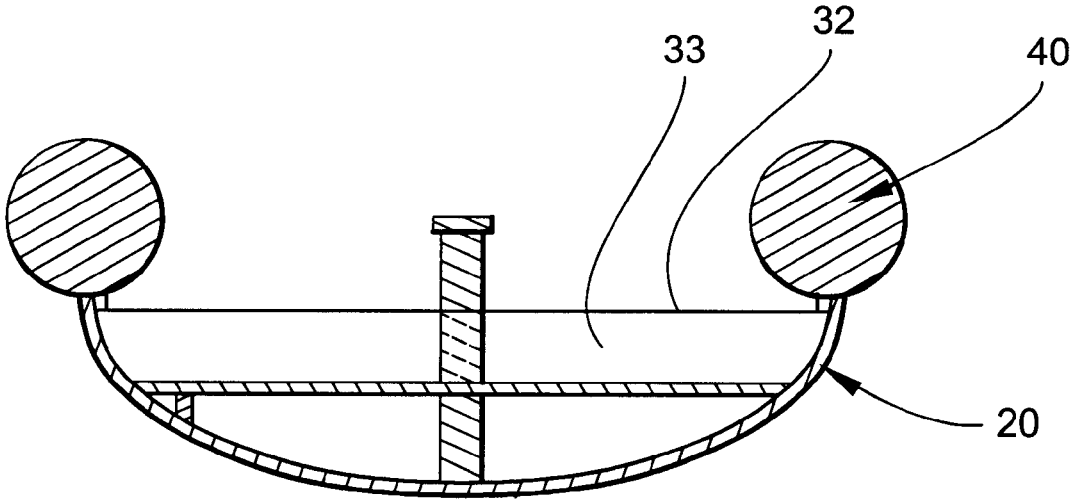
FIG. 7 is a cross-sectional view taken through line 4—4 of FIG. 6.

As is shown in FIG. 6, the hinge element 30 may alternatively be formed from a piano hinge 31. FIG. 6 also shows a mating bow bulkhead 32 and stern bulkhead 33. In contrast to known prior art devices, the bow bulkhead 32 and stern bulkhead 33 can be placed at any height below the juncture of the inflatable topsides 40 and hull 20. FIG. 7 shows the mating bow and stern bulkheads 32 and 33, respectively, placed several inches below the juncture of the inflatable topsides 40 and the hull 20. As is shown in FIG. 4, the bow and stern bulkheads 32 and 33 include a gasket 34 for creating an enhanced barrier against water intrusion.

A boat apparatus is described above. Various details of the invention may be changed without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A folding rigid-inflatable boat for routine and emergency use by occupants as an auxiliary watercraft, comprising:

(a) complementary rigid bow and rigid stern sections joined together along respective mating edges to form a hull;

(b) complementary hinge elements cooperating together to form a centrally-disposed joint pivotally connecting said bow and stern sections together along said mating edges for permitting the bow and stern sections to be folded onto themselves into a storage configuration and away from each other into an unfolded use configuration;

(c) inflatable topsides secured to said hull along at least port and starboard sides of the hull for providing an upwardly extending freeboard and for further providing rigidity to the hull when said boat is in said unfolded use configuration; and (d) a membrane extending along the mating edges and sealingly affixed to the bow section, the stern section and adjacent the inflatable topsides, thereby forming a void between said membrane and said hinge elements and defining a watertight compartment for trapping and containing leakage past the hinge elements and through said centrally-disposed joint.

2. A folding rigid-inflatable boat for routine and emergency use by occupants as an auxiliary watercraft comprising:

(a) a hull comprised of complementary rigid bow and rigid stern sections including respective transversely-extending mating bulkhead elements;

(b) complementary hinge elements cooperating together for pivotally connecting said mating bulkhead elements together for permitting said bow and stern sections to be folded onto themselves into a storage configuration and away from each other into an unfolded use configuration, wherein said mating bulkhead sections are joined together to form a centrally-disposed joint defining a single bulkhead extending along said joint;

(c) inflatable topsides secured to said hull along at least port and starboard sides of said hull for providing an upwardly extending freeboard and for further providing rigidity to the hull when said boat is in said unfolded use configuration; and (d) a membrane extending along the centrally-disposed joint and sealingly affixed to the bow section, the stern section and adjacent the inflatable topsides, thereby forming a void between said membrane and said hinge elements and defining a watertight compartment for trapping and containing leakage past the hinge elements and through the centrally-disposed joint.

3. A folding inflatable boat according to claim 1 or 2, wherein said hinge elements comprise two rigid scissor hinges.

4. A folding rigid-inflatable boat according to claim 3, and including supplemental securing means for securing said bow section and stern sections together in the unfolded use configuration to define a rigid hull.

5. A folding inflatable boat according to claim 1 or 2, wherein said membrane comprises a fabric waterdam extending laterally from port to starboard and enclosing the hinge element, thereby preventing water leakage into the boat through said centrally-disposed joint edges and the hinge element.

6. A folding inflatable boat according to claim 1 or 2, and including a retrievable drogue connected to the hull and deployable into the water for providing drag to the boat and thus resistance against capsizing or excessive hull rolling.

7. A folding inflatable boat according to claim 1 or 2, and including rigid topsides positioned intermediate with the hull and the inflatable topsides, wherein said rigid topsides have a lower edge extending around a periphery of and connected to the hull, thereby extending the freeboard of the boat and positioning the inflatable topsides above the waterline reducing drag on the hull.

8. A folding rigid-inflatable boat according to claim 7, and including automatic inflation means for inflating the inflatable topsides.

9. A folding inflatable boat according to claim 1 or 2, and including at least one sealed sole compartment defined by said hull for promoting buoyancy of said boat.

10. A folding rigid-inflatable boat according to claim 9, wherein said sole compartment includes at least one storage locker positioned within the sole compartment for storing emergency equipment within the storage locker and reserve buoyancy.

11. A folding inflatable boat according to claim 1 or 2, including a canopy for being positioned and retained over at least part of the hull for protecting the occupants of said boat.

12. A folding rigid-inflatable boat according to claim 11, wherein said canopy comprises removable canopy bow and canopy stern sections for being connected to said inflatable topsides, and at least one hinged hoop support connected to and for supporting the canopy.

13. A folding rigid-inflatable boat according to claim 12, wherein the canopy includes a plurality of watertight windows and a doorway.

14. A folding inflatable boat according to claim 13, wherein said canopy is wrapped around the inflatable topsides and attached to the hull by a plurality of mechanical attachment devices.

15. A folding inflatable boat according to claim 1, and including supplemental securing means comprising at least one securing screw pin for locking the bow and stern sections in a mating position along the mating edges.

16. A folding inflatable boat according to claim 2, and including supplemental securing means comprising at least one securing screw pin for locking the mating bulkhead elements in a mating position.

17. A folding inflatable boat according to claim 16, wherein the mating bulkhead elements include gasket means for cushioning and sealing the bow and stern sections and creating an enhanced barrier against water intrusion.

* * * * *